US005683003A

United States Patent [19]

Gebka

[11] Patent Number: 5,683,003

[45] Date of Patent: Nov. 4, 1997

[54] STRIP MERCHANDISER HANGER AND LABEL HOLDER

[75] Inventor: John Gebka, Coral Springs, Fla.

[73] Assignee: Fast Industries, Inc., Ft. Lauderdale, Fla.

[21] Appl. No.: 630,832

[22] Filed: Apr. 10, 1996

[51] Int. Cl.[6] ..... A47F 5/00

[52] U.S. Cl. ..... 211/57.1; 211/73; 211/113; 211/118; 248/304; 40/642; 40/666

[58] Field of Search ..... 248/220.41, 220.43, 248/222.51, 304; 40/658, 666, 642; 211/113, 118, 57.1, 73

[56] References Cited

U.S. PATENT DOCUMENTS

| | | | |
|---|---|---|---|
| 4,476,983 | 10/1984 | Fast | 211/57.1 |
| 4,483,502 | 11/1984 | Fast | 248/223.41 |
| 4,497,464 | 2/1985 | Fast | 248/220.31 |
| 4,546,943 | 10/1985 | Fast | 211/57.1 |
| 4,718,627 | 1/1988 | Fast et al. | 211/113 |
| 4,911,392 | 3/1990 | Fast | 248/220.31 |
| 5,346,166 | 9/1994 | Valiulis | 248/220.41 |
| 5,386,916 | 2/1995 | Valiulis | 211/113 |
| 5,415,370 | 5/1995 | Valiulis | 248/220.41 |

OTHER PUBLICATIONS

Graphex Incorporated Advertisement entitled "Twin Hook Clip Strip and Sign Extender", #072195.

Fast Industries, Inc. Sell Sheet entitled "The Reversible Fold–A–Strip Sell Strip® Merchandiser".

Fasteners For Retail catalog entitled "1996 Buyers Guide", pp. 33, 43, 51–54.

*Primary Examiner*—Leslie A. Braun

*Assistant Examiner*—Donald J. Wallace

*Attorney, Agent, or Firm*—Jacobson, Price, Holman & Stern, PLLC

[57] ABSTRACT

A molded plastic display device adapted to be removably secured to a generally horizontally extending shelf perpendicularly to the front edge thereof, with a central upstanding label holder, both surfaces of which can be provided with merchandising indicia. A transparent label cover enables the label holder to carry adhesive or non-adhesive labels or signs. A pair spaced hooks are provided below each label-receiving surface to support, in depending fashion, strip merchandisers carrying a multiplicity of products. Depending upon the width of the products being carried by the strip merchandisers, they may be selectively hung from whichever hook is closest to the shelf to minimize projection of the products into the aisle. The display device includes a simple foot and post mounting arrangement that provides secure cantilevered support even for a pair of fully loaded strip merchandisers, while permitting installation in only a single fashion so as to minimize the likelihood that inexperienced users will improperly install the display device on the shelf.

10 Claims, 4 Drawing Sheets

STRIP MERCHANDISER HANGER AND LABEL HOLDER

BACKGROUND OF THE INVENTION

1. Field of the Invention

This invention relates to a display device, and relates more particularly to a combination hanger for suspending a pair of strip merchandisers and a label holder for displaying information related to the products carried by the strip merchandisers. The display device of this invention is adapted to be removably secured to a generally horizontally extending shelf perpendicularly to the front edge thereof, with a central upstanding label holder, both surfaces of which can also be provided with merchandising indicia. Preferably, a pair of spaced hooks are provided below each label-receiving surface to support, in depending fashion, strip merchandisers carrying a multiplicity of products. In this manner, the merchandising indicia and the products carried by the strip merchandisers are visibly presented to customers passing in both directions along an aisle between rows of parallel shelves such as may be found in a supermarket or the like.

2. Description of Related Art

Small products such as packages of snack foods, e.g., potato chips or pretzels, or blister packs of batteries, one-drop room deodorizers and the like are commonly displayed forwardly of the front edge of a horizontally extending shelf in a store such as a supermarket, with the shelves themselves being used to support other products. In some instances, such products are suspended, in overlapping fashion, on hook-like members such as J-hooks or the like, or, in partially overlapping fashion, on elongated strips such as the clip strip shown in Fast U.S. Pat. No. 4,476,983 or other forms of strip merchandisers such as seen, for example, in Fast U.S. Pat. Nos. 4,483,502, 4,546,943 and 4,718,627.

The instant inventive concepts are particularly directed to the provision of a display device for, inter alia, supporting strip merchandisers, such as those disclosed in the aforementioned Fast patents, although shortened versions of such merchandisers, such as shown in Fast U.S. Pat. No. 4,911,392, which are more like a modified J-hook, can also be conveniently carried by the hanger of the instant invention. The disclosure of all of the Fast patents referred to above are incorporated herein in their entirety by reference.

Heretofore, such strip merchandisers have been supported by the shelf in depending fashion with the products carried thereby and any label associated therewith oriented generally parallel to the front edge of the shelf, limiting their visibility to customers passing through the aisle parallel to the array of shelves on either side. More recently, hangers have been proposed which are adapted to support strip merchandisers and/or product labels perpendicularly to the front edge of the shelves so as to face the flow of customers as they pass through the store aisles.

For example, Valiulis U.S. Pat. Nos. 5,386,916 and 5,415,370 each disclose a metal rod, one end of which is mounted in the apertures commonly formed in spaced rows through the upper surface of the shelf, with the opposite end cantilevered into the aisle. A hook is formed on the free end of the metal rod for receiving a strip merchandiser, and a plate is carried intermediate the rod ends for adhesively receiving a product label.

Valiulis U.S. Pat. No. 5,346,166 provides a modified hanger assembly wherein the metal rod has been replaced with a metal plate having a pair of depending wings, each of which is adapted to carry a strip merchandiser and a product label so that products and labels can be presented to customers passing in both directions down the aisle.

An integral molded plastic hanger adapted to support a pair of strip merchandisers facing in opposite directions, much like the modified Valiulis hanger assembly, with a groove adapted to receive and support a sign or the like, has been offered for sale by Graphex Incorporated of Exton, Pa.

The Valiulis hanger assemblies, being formed from metal, have obvious disadvantages, not the least of which is the relatively sharp edges associated with products of this nature, a defect particularly undesirable since such hangers are designed to extend into the aisle, sometimes at or about eye level of a passerby.

A problem associated with both the Graphex product and the Valiulis double hanger assembly is the manner in which these products are mounted on the merchandise shelf. The single Valiulis hanger assemblies are designed to utilize a single pair of front-to-back aligned holes in the horizontally extending shelf surface. Both Valiulis and Graphex, when supporting a pair of strip merchandisers, provide mounting elements designed to engage a pair of laterally-spaced shelf apertures in the second row of apertures in the shelf surface. Not only does this arrangement somewhat reduce the surface available for supporting other products on the shelf, it is not uncommon for inexperienced users of such products to engage the mounting elements in holes in the first row of apertures in the shelf surface, projecting the hanger and the products supported thereby further into the aisle than is necessary, and significantly reducing the stability of the hanger device and its ability to effectively cantilever a pair of fully loaded strip merchandisers forwardly of the shelf.

Additionally, neither the Valiulis nor the Graphex products enable the presentation of significant merchandising information. The Valiulis hangers are designed to receive only small adhesive labels, while the Graphex groove can only support a relatively rigid cardboard or plastic sign. Neither device is versatile, nor can either device effectively display a simple non-adhesive paper label or the like.

SUMMARY OF THE INVENTION

It is therefore a primary object of the present invention to provide an integral plastic display device which orients multiple strip merchandisers and product labels generally perpendicularly to the front edge of a merchandise shelf in a simple, inexpensive and versatile manner.

An important object of this invention is to provide a display device for supporting multiple strip merchandisers, with an upstanding label holder adapted to receive and support both adhesive and non-adhesive labels or signs in a secure and efficient manner.

A further another object of this invention is the provision of an integral plastic display device, which includes a mounting portion adapted to rest on an inclined front edge surface of a shelf to maximize the cantilevered support for a pair of loaded strip merchandisers that are carried by the hanger assembly in spaced relationship to the front edge of the shelf.

Still another important object of this invention is the provision of a strip merchandiser hanger and label holder adapted to carry a pair of strip merchandisers, with the products supported thereby facing customers passing along the aisle from either direction, utilizing a simple foot and post mounting system which stabilizes the hanger, preventing sidewise twisting or rocking, maximizes the surface area available for supporting other products on the shelf, and can only be engaged with the shelf in a single manner so as to avoid improper installation by inexperienced users.

Yet another object of this invention is the provision of a display device of the type referred to including a pair of upstanding hooks on each side of its central axis, spaced from each other such that, depending on the width of the products carried by the strip merchandisers, the user can select a hook closest to the shelf to minimize projection of the strip merchandisers into the store aisle, thus reducing an injury risk to customers and personnel passing there along.

BRIEF DESCRIPTION OF THE DRAWINGS

The above and still further objects, features and advantages of the present invention will be readily understood or become apparent upon consideration of the following detailed description of the preferred embodiments hereof, especially when taken in conjunction with the accompanying drawings wherein.

DESCRIPTION OF THE PREFERRED EMBODIMENT(S)

Figure 6:
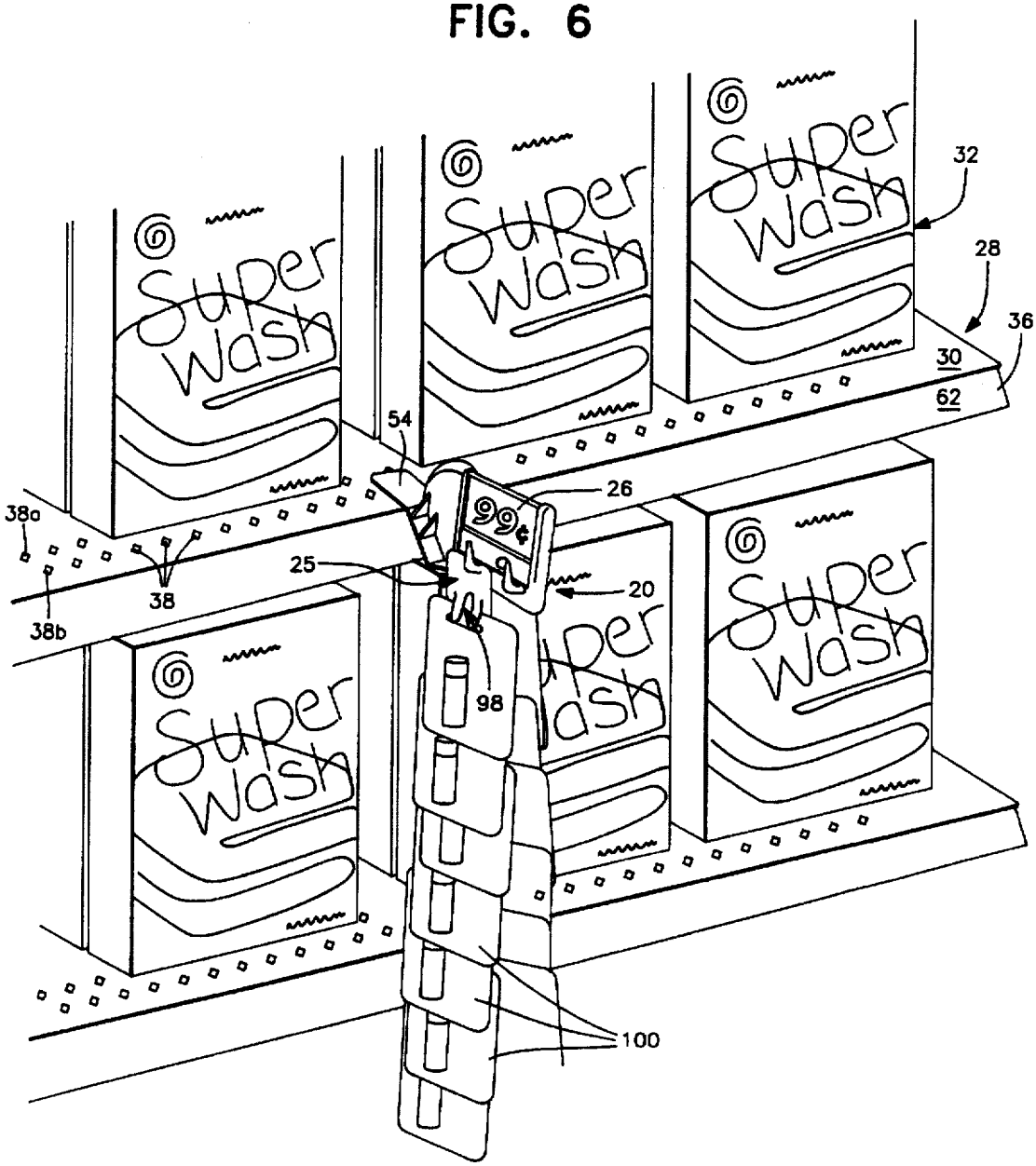
FIG. 6 is a perspective view of a strip merchandiser hanger and label holder according to this invention in use, supporting, on hooks closest to the shelf, a pair of strip merchandisers carrying a multiplicity of partially overlapped blister-carded products.
Figure 7:
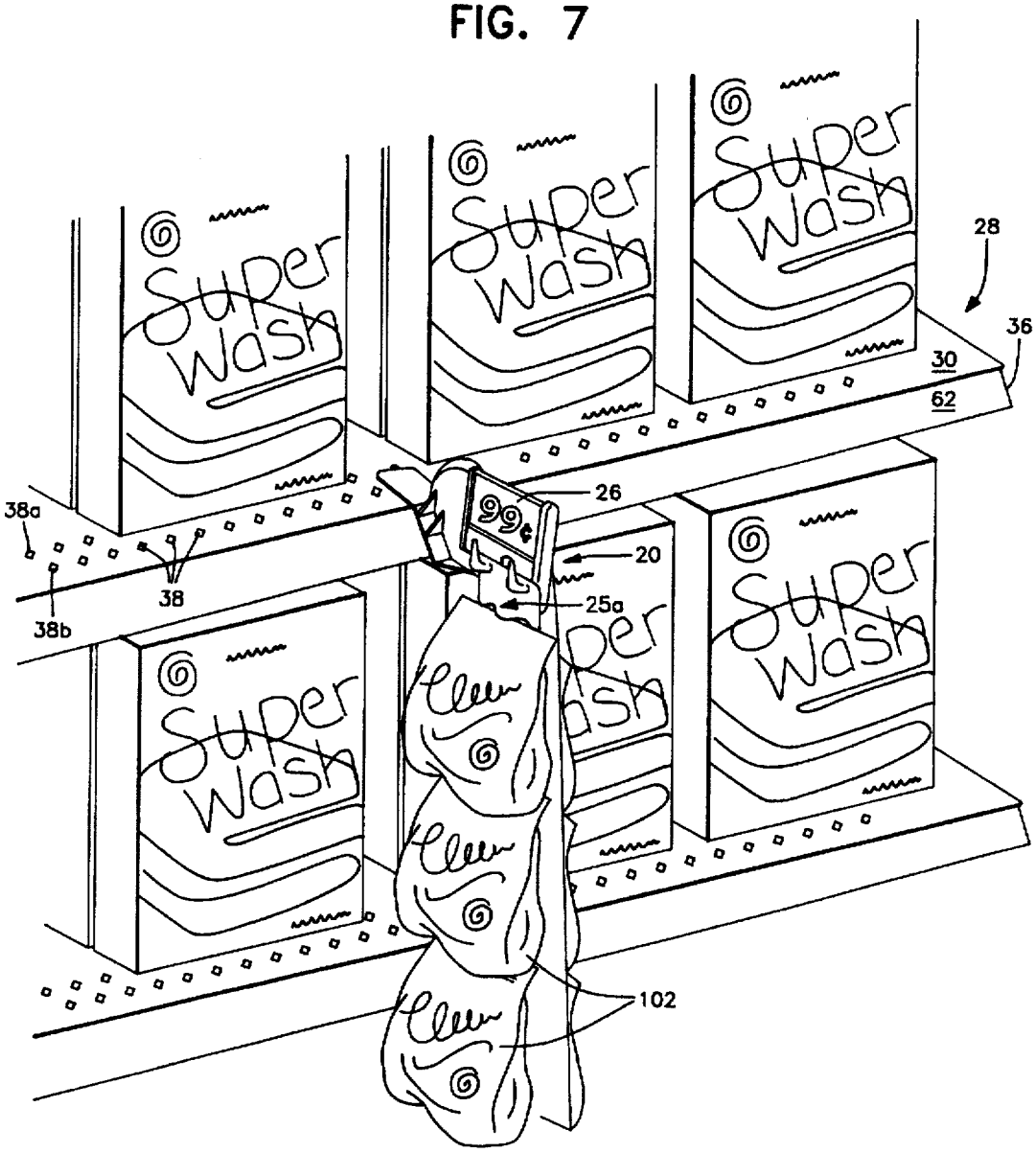
FIG. 7 is a view similar to FIG. 6, but showing strip merchandisers carrying under products supported on hooks farther from the shelf.

Referring now to the drawings, wherein like parts are designated by like characters, and particularly to FIGS. 1–7, an integral injection molded plastic display device according to this invention is designated generally by the reference numeral 20. The display device 20, as seen in FIGS. 6 and 7, is adapted to be mounted on a generally horizontally extending shelf 28, having an upper surface 30 for reception of products 32, a lower surface 34 and an elongated front edge flange 36. Commonly, shelves 28 includes a multiplicity of spaced apertures 38 extending therethrough in rows parallel to the front edge flange 36. The apertures 38 are shown as diamond-shaped, but oftentimes are round.

The display device 20 is generally symmetrical about an elongated central axis 44 and includes a mounting portion 46 covering approximately the rearward half of the device, and a supporting portion 48 covering approximately the forward half of the device. The mounting portion 46 is adapted to removably secure the display device 20 to the shelf 28 with the central axis 44 of the display device 20 perpendicular to the front edge 36 of the shelf 28.

The preferred mounting means, as shown in the drawings, is a simple foot 50 and post 52 arrangement. A base 54 includes a flat lower surface 56 adapted to rest on the forwardmost portion of the upper surface 30 of the shelf 28 and prevent rocking of the display device 20 from side-to-side. The foot 50, which is dimensioned to be received through an aperture **38*a* in the second row of apertures 38 in the shelf 28, extends centrally from the rearwardmost edge of the base 54 and is parallel to, and spaced below, the base 54 by a shoulder 58 slightly larger than the thickness of the shelf 28 between its upper and lower surfaces 30, 34, respectively. Thus, when the foot 50 is received through the aperture 38*a*, the upper surface 60 of the foot 50 engages against the lower surface 34 of the shelf 28 as seen particularly in FIG. 1**.

The post 52 depends from the lower surface 56 of the base 54, along the central axis 44 of the display device 20 forwardly of the foot 50. The post 52 is formed as a frusto-pyramid for reception in an aperture **38*b* in the first row of apertures 38 in the shelf 28, whether the aperture 38*b* is round or of a diamond configuration as shown. Engagement of the post 52 in the aperture 38*b* stabilizes the display device 20 and precludes the same from swivelling about the engagement of the foot 50 with the shelf 28. Failure to properly engage the foot 50 in an aperture 38*a* in the second row of apertures 38 will result in the post 52 engaging the upper surface 30 of the shelf 28 or the front surface 62 of the front edge flange 36 making it evident to even an unexperienced user that the display device 20** has been improperly installed.

If, as shown in the drawings, the front edge flange 36 of the shelf 28 includes a downwardly and outwardly extending front surface 62, the mounting portion 46 of the display device 20 further includes a transition member 64 extending between the forwardmost edge 66 of the base 54 and the rearwardmost edge of the supporting portion 48. The transition member 64 includes a lower surface 68 extending downwardly and outwardly from the lower surface 56 of the base 54 at the same angle as the front surface 62 of the front edge flange 36 of the shelf 28. By resting the lower surface 68 of the transition member 64 on the front surface 62 of the front edge flange 36 of the shelf 28, the cantilevered support for a pair of loaded strip merchandisers, to be carried by the supporting portion 48 of the display device 20 in spaced relationship to the front edge 36 of the shelf 28 as will be discussed in more detail hereinafter, is maximized.

A central flange 65 connects the mounting and supporting portions 46, 48 to increase the rigidity of the product and ribs such as shown at 67 may optionally be included if necessary to further strengthen the display device 20.

The supporting portion 48 of the display device 20 includes an upstanding label holder 70 extending along the central axis 44 and having an upper edge 72 and a depressed portion forming a label-receiving surface 74 on each side thereof. Each of the depressed label-receiving surfaces 74 are defined by a lower shoulder 76 and front and rear vertically extending flanges 78, 80 which, together, define guides to facilitate positioning an adhesive product label such as shown at 26 thereon.

Figure 1:
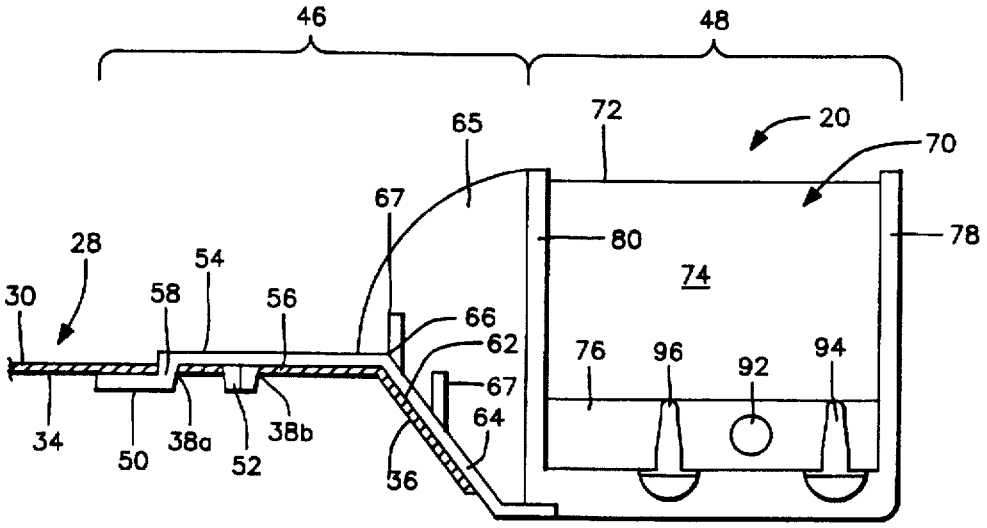
FIG. 1 is a side elevational view of a preferred embodiment of a display device in the nature of a strip merchandiser hanger and label holder according to the instant invention, with a fragmentary portion of a shelf being shown in cross-section for illustrative clarity.
Figure 10:
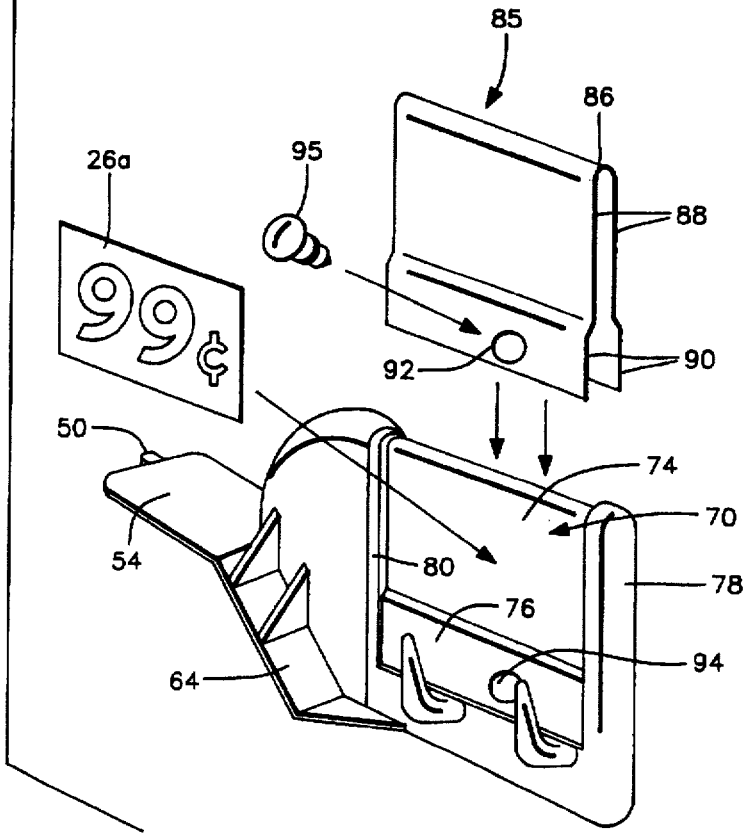
FIG. 10 is an exploded perspective view of the strip merchandiser hanger and label holder of the instant invention, showing the manner in which the label cover is associated therewith use.
Figure 2:
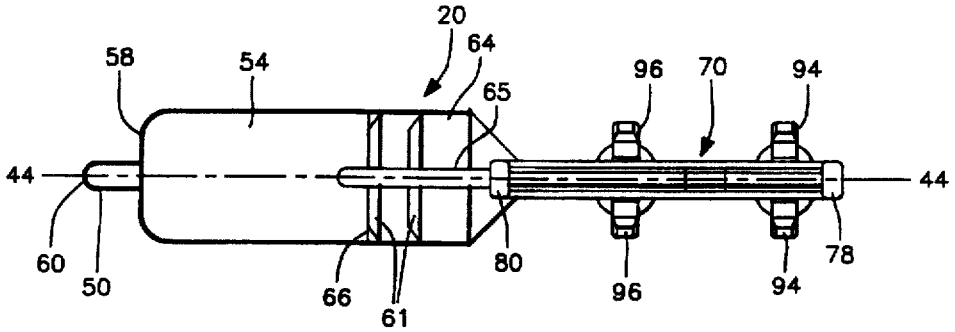
FIG. 2 is a top plan view of the display device of this invention.
Figure 3:
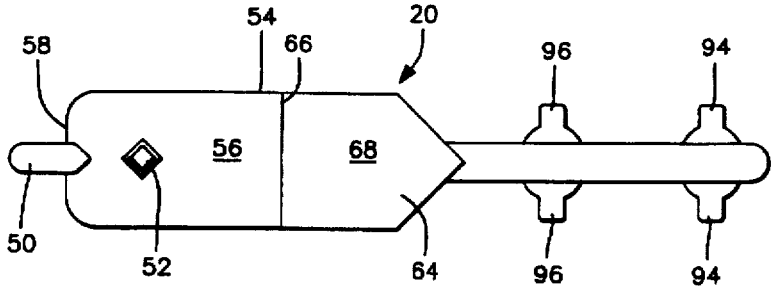
FIG. 3 is a bottom plan view thereof.
Figure 4:
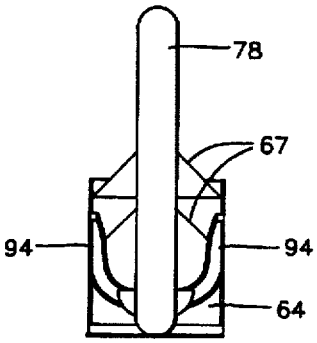
FIG. 4 is a front elevational view thereof.
Figure 5:
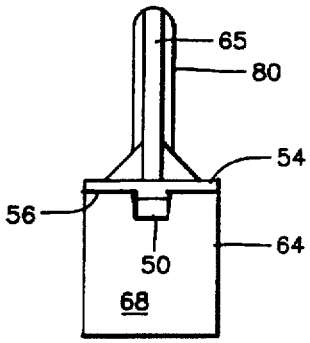
FIG. 5 is a rear elevational view thereof.
Figure 8:
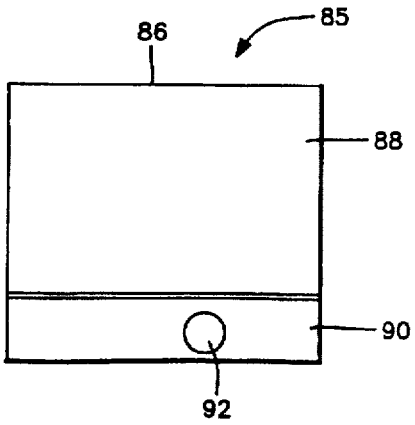
FIG. 8 is a side elevational view of a label cover adapted for use with the label holder when non-adhesive product labels are to be carried thereby.
Figure 9:
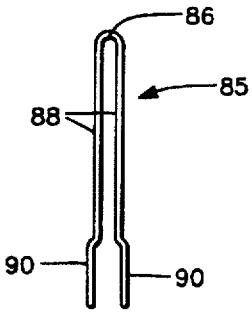
FIG. 9 is an end elevational view of the label cover.

If it is desired to display a non-adhesive product label or sign **26*a*, the display device 20 may be provided with a generally U-shaped label cover 85 as shown in FIGS. 8–10. The label holder 85 comprises a connecting portion 86** adapted to rest on the upper edge 72 of the label holder 70. Transparent panel members 88 depend from the connecting portion 86 and extend over each of the label-receiving surfaces 74 of the label holder 70 to define a pocket between each of the label-receiving surfaces 74 and its overlying panel member 88 for reception of a non-adhesive label 26*a*.

The lower ends of the label cover 85, below the transparent panel members 88, are offset as shown at 90 to overly the shoulders 76 of the label holder 70. An aperture 92 is provided in at least one, and preferably both, of the offset portions 90, and an aligned aperture 94 is provided in the shoulder 76 of the label holder 70 for reception of a push pin 95 to secure the label cover 70 in position after the non-adhesive labels 26*a* have been received in the aforementioned pockets.

The supporting portion 48 of the display device 20 further includes at least one, and preferably a pair of, upstanding hooks 94, 96 below the label-receiving surface 74 on each side of the label holder 70. Each of the hooks 94, 96 are adapted to receive and support, in depending fashion, a strip merchandiser such as those described hereinabove with reference to the aforementioned Fast patents. The nature of the strip merchandiser is not relevant to the instant inventive concepts, and different forms of strip merchandisers are shown 25 and 25*a*, respectively, in FIGS. 6 and 7, merely as illustrative.

The strip merchandiser 25 shown in FIG. 6 has the triple-finger locking mechanism 98 seen in several of the Fast patents, adapted to receive and hold blister-carded products 100 or the like in partially overlapping depending fashion. The modified strip merchandiser shown at 25*a* in FIG. 7 is of the clip-strip variety, and is particularly adapted to carry a plurality of snack products 102 or the like as shown illustratively in this Figure.

In either event, the strip merchandiser will generally include a mounting aperture at its upper end, adapted to be selectively received over one of the hooks 94 or 96, on each side of the display device 20. By providing at least two longitudinally-spaced hooks on each side of the label holder 70, a strip merchandiser may be selectively hung on the hook which is positioned as close to the front edge flange 36 of the shelf 28 as the width of the products carried by the strip merchandiser will permit. For example, in FIG. 6, where the blister-carded products are of a somewhat narrower width, the strip merchandisers 25 are hung on the inner hooks 96. In contrast, in FIG. 7, where the bags of snack products 102 are somewhat wider, the strip merchandisers 25*a* are hung on the outer hooks 94. By providing for selectively supporting the strip merchandisers as close as possible to the shelf, loss of aisle space is minimized, as is the likelihood that a passerby will accidentally engage the strip merchandiser, injuring the individual, or damaging the strip or the merchandise carried by the strip.

Each of the elements forming the strip merchandiser and label holder of the instant invention may be made of any suitable material and manufactured by any conventional molding technique. However, they are most effectively injection molded, with the display device 20 being formed of polypropylene, the label cover 25 being formed of polyvinyl chloride, and the push pin 95 being formed of nylon.

It is believed that the use of the display device of the instant invention is self-evident from the aforementioned detailed description of its construction, the manner in which the display device is engaged with the shelf, and the manner in which product-carrying strip merchandisers and product labels are engaged with the display device. From a consideration of the foregoing, it is seen that the objects of the instant invention outlined above, and other features and advantages hereof, are met.

While preferred embodiments of the instant invention have been described and illustrated herein, it will be clear that variations of the details of construction which are specifically shown and described, may be resorted to without departing from the true spirit and scope of the invention as defined in the appended claims.

I claim:

1. A plastic display device for supporting multiple strip merchandisers and product labels from a generally horizontally extending shelf having an upper and a lower surface and an elongated front edge, said display device including a forward end, a rearward end, an elongated central axis and further comprising:

a) a mounting portion at said rearward end adapted to removably secure said display device to the shelf with its central axis perpendicular to the front edge thereof; and b) a supporting portion at said forward end including:

i) an upstanding label holder extending along said central axis and having an upper edge and label-receiving surfaces on each side thereof, each of said label-receiving surfaces being adapted to receive and display a label containing product information, and ii) at least one upstanding hook below said label-receiving surface on each side of said label holder, each of said hooks being adapted to receive and support, in depending fashion, a product-carrying strip merchandiser, said shelf including a plurality of spaced apertures extending therethrough in rows parallel to the front edge thereof, said mounting portion of said display device including a base having a flat lower surface adapted to rest on the forwardmost portion of the upper surface of the shelf, a foot extending from the rearwardmost edge of said base along said central axis, said foot being parallel to, and spaced below, said base, a shoulder slightly larger than the thickness of the shelf between its upper and lower surfaces connecting said foot to said base, said foot being dimensioned to pass through an aperture in the second row of apertures in the shelf and including an upper surface adapted to be engaged against the lower surface of the shelf, and a post depending from said lower surface of said base along said central axis forwardly of said foot and adapted to be received in an aperture in the first row of apertures in the shelf to stabilize said display device and preclude the same from swivelling about the engagement of said foot with the shelf, and said shelf including a front edge flange with a front surface which extends downwardly and outwardly at an angle from the front edge of the shelf, and said mounting portion of said display device further includes a transition member extending between the forwardmost edge of said base and said supporting portion of said display device, said transition member including a lower surface extending downwardly and outwardly from said lower surface of said base at the same angle as the front surface of the front edge flange of the shelf, said lower surface of said transition member being adapted to rest on the front surface of the front edge flange, whereby said mounting portion of said display device is adapted to cantilever said supporting portion of said display device forwardly of the shelf.

2. A plastic display device for supporting multiple strip merchandisers and product labels from a generally horizontally extending shelf having an upper and a lower surface and an elongated front edge, said display device including a forward end, a rearward end, an elongated central axis and further comprising:

a) a mounting portion at said rearward end adapted to removably secure said display device to the shelf with its central axis perpendicular to the front edge thereof; and b) a supporting portion at said forward end including:

i) an upstanding label holder extending along said central axis and having an upper edge and label-receiving surfaces on each side thereof, each of said label-receiving surfaces being adapted to receive and display a label containing product information, and ii) at least two longitudinally spaced hooks below said label-receiving surface on each side of said label holder, each of said hooks being adapted to receive and support, in depending fashion, a product-carrying strip merchandiser, whereby a strip merchandiser may be selectively hung on the hook on each side which is positioned as close to the shelf as the width of the products carried by the strip merchandiser will permit.

3. A plastic display device for supporting multiple strip merchandisers and product labels from a generally horizontally extending shelf having an upper and a lower surface and an elongated front edge, said display device including a forward end, a rearward end, an elongated central axis and further comprising:

a) a mounting portion at said rearward end adapted to removably secure said display device to the shelf with its central axis perpendicular to the front edge thereof; and b) a supporting portion at said forward end including:

i) an upstanding label holder extending along said central axis and having an upper edge and label-receiving surfaces on each side thereof, each of said label-receiving surfaces being adapted to receive and display a label containing product information, and ii) at least one upstanding hook below said label-receiving surface on each side of said label holder, each of said hooks being adapted to receive and support, in depending fashion, a product-carrying strip merchandiser, wherein said label holder defines a shoulder beneath each of its label-receiving surfaces to facilitate positioning a product label thereon.

4. A plastic display device for supporting multiple strip merchandisers and product labels from a generally horizontally extending shelf having an upper and a lower surface and an elongated front edge, said display device including a forward end, a rearward end, an elongated central axis and further comprising:

a) a mounting portion at said rearward end adapted to removably secure said display device to the shelf with its central axis perpendicular to the front edge thereof; and b) a supporting portion at said forward end including:

i) an upstanding label holder extending along said central axis and having an upper edge and label-receiving surfaces on each side thereof, each of said label-receiving surfaces being adapted to receive and display a label containing product information, and ii) at least one upstanding hook below said label-receiving surface on each side of said label holder, each of said hooks being adapted to receive and support, in depending fashion, a product-carrying strip merchandiser, further including a generally U-shaped label cover comprising a connecting portion adapted to rest on said upper edge of said label holder, and transparent panel members depending from said connecting portion and adapted to extend over each of said label-receiving surfaces of said label holder to thereby define a pocket between each of said label-receiving surfaces and its overlying panel member for reception of a non-adhesive product label on each side of said label holder.

5. The display device of claim 4, further including an aperture defined through said label holder below said label-receiving surfaces, an aligned aperture defined through the lower portions of at least one of said panel members of said label cover, and a push pin adapted to be engaged through said apertures of said label cover and said label holder to secure said label cover in position.

6. In combination, a generally horizontally extending shelf having an upper and lower surface and an elongated front edge, and at least one display device including a forward end, a rearward end, an elongated central axis and further comprising:

a) a mounting portion at said rearward end adapted to removably secure said display device to the shelf with its central axis perpendicular to the front edge thereof; and b) a supporting portion at said forward end including i) an upstanding label holder extending along said central axis and having an upper edge and label-receiving surfaces on each side thereof, each of said label-receiving surfaces being adapted to receive and display a label containing product information, and ii) at least one upstanding hook below said label-receiving surface on each side of said label holder, each of said hooks being adapted to receive and support, in depending fashion, a product-carrying strip merchandiser, said display device being secured to said shelf by its respective mounting portion with its central axis perpendicular to said front edge of said shelf, including a plurality of spaced apertures extending therethrough in rows parallel to said front edge thereof, said mounting portion of said display device including a base having a flat lower surface resting on the forwardmost portion of said upper surface of said shelf, a foot extending from the rearwardmost edge of said display device along said central axis, said foot being parallel to, and spaced below, said base by a shoulder slightly larger than the thickness of said shelf between its upper and lower surfaces connecting said foot to said base, said foot passing through an aperture in the second of said rows of apertures in said shelf and including an upper surface engaged against said lower surface of said shelf, and a post depending from said lower surface of said base along said central axis forwardly of said foot and received in an aperture in the first of said rows of apertures in said shelf to stabilize said display device and preclude the same from swivelling about the engagement of said foot with said shelf, said shelf including a front edge flange having a front surface which extends downwardly and outwardly at an angle from said front edge thereof, and said mounting portion of said display device further includes a transition member extending between the forwardmost edge of said base and said supporting portion of said display device, said transition member including a lower surface extending downwardly and outwardly from said lower surface of said base at the same angle as said front surface of said front edge flange of said shelf, said lower surface of said transition member resting on said front surface of said front edge flange, whereby said mounting portion for said display device cantilevers said supporting portion of said display device forwardly of said shelf.

7. In combination, a generally horizontally extending shelf having an upper and lower surface and an elongated front edge, and at least one display device including a forward end, a rearward end, an elongated central axis and further comprising:

a) a mounting portion at said rearward end adapted to removably secure said display device to the shelf with its central axis perpendicular to the front edge thereof; and b) a supporting portion at said forward end including i) an upstanding label holder extending along said central axis and having an upper edge and label-receiving surfaces on each side thereof, each of said label-receiving surfaces being adapted to receive and display a label containing product information, and ii) at least one upstanding hook below said label-receiving surface on each side of said label holder, each of said hooks being adapted to receive and support, in depending fashion, a product-carrying strip merchandiser, said display device being secured to said shelf by its respective mounting portion with its central axis perpendicular to said front edge of said shelf, further including a product label carried by each of said label-receiving surfaces, and a strip merchandiser carried by a hook on each side of said label holder, said supporting portion of said display device including at least two longitudinally-spaced hooks below said label-receiving surface on each side of said label holder, whereby the strip merchandiser is selectively hung on the hook on each side which is positioned as close to said shelf as the width of the products carried by said strip merchandiser will permit.

8. In combination, a generally horizontally extending shelf having an upper and lower surface and an elongated front edge, and at least one display device including a forward end, a rearward end, an elongated central axis and further comprising:

a) a mounting portion at said rearward end adapted to removably secure said display device to the shelf with its central axis perpendicular to the front edge thereof; and b) a supporting portion at said forward end including i) an upstanding label holder extending along said central axis and having an upper edge and label-receiving surfaces on each side thereof, each of said label-receiving surfaces being adapted to receive and display a label containing product information, and ii) at least one upstanding hook below said label-receiving surface on each side of said label holder, each of said hooks being adapted to receive and support, In depending fashion, a product-carrying strip merchandiser, said display device being secured to said shelf by its respective mounting portion with its central axis perpendicular to said front edge of said shelf, said label holder defining a shoulder beneath each of its label-receiving surfaces to facilitate positioning a product label thereon.

9. In combination, a generally horizontally extending shelf having an upper and lower surface and an elongated front edge, and at least one display device including a forward end, a rearward end, an elongated central axis and further comprising:

a) a mounting portion at said rearward end adapted to removably secure said display device to the shelf with its central axis perpendicular to the front edge thereof; and b) a supporting portion at said forward end including i) an upstanding label holder extending along said central axis and having an upper edge and label-receiving surfaces on each side thereof, each of said label-receiving surfaces being adapted to receive and display a label containing product information, and ii) at least one upstanding hook below said label-receiving surface on each side of said label holder, each of said hooks being adapted to receive and support, in depending fashion, a product-carrying strip merchandiser, said display device being secured to said shelf by its respective mounting portion with its central axis perpendicular to said front edge of said shelf, further including a generally U-shaped label cover comprising a connecting portion resting on said upper edge of said label holder, and a transparent panel member depending from said connecting portion and extending over each of said label-receiving surfaces of said label holder to thereby define a pocket between each of said label-receiving surfaces and its overlying panel member, and a non-adhesive product label received in each of said pockets.

10. The combination of claim 9, further including an aperture defined through said label holder below said label-receiving surfaces, an aligned aperture defined through the lower portions of at least one of said panel members of said label cover, and a push pin engaged through said apertures of said label cover and said label holder to secure said label cover in position.

* * * * *